US008482468B2

(12) United States Patent
Park

(10) Patent No.: US 8,482,468 B2
(45) Date of Patent: Jul. 9, 2013

(54) ANTENNA CONNECTION DEVICE

(76) Inventor: Jin-Woo Park, Gunpo-si (KR)

( * ) Notice: Subject to any disclaimer, the term of this patent is extended or adjusted under 35 U.S.C. 154(b) by 381 days.

(21) Appl. No.: 12/992,630

(22) PCT Filed: May 8, 2009

(86) PCT No.: PCT/KR2009/002436
§ 371 (c)(1),
(2), (4) Date: Nov. 15, 2010

(87) PCT Pub. No.: WO2009/142404
PCT Pub. Date: Nov. 26, 2009

(65) Prior Publication Data
US 2011/0063186 A1 Mar. 17, 2011

(30) Foreign Application Priority Data
May 19, 2008 (KR) ..... 10-2008-0046205

(51) Int. Cl.
*H01Q 1/24* (2006.01)

(52) U.S. Cl.
USPC ..... 343/702; 343/906

(58) Field of Classification Search
USPC ..... 343/702, 906, 900, 901; 439/66, 439/71, 862
See application file for complete search history.

(56) References Cited

U.S. PATENT DOCUMENTS

| | | | | |
|---|---|---|---|---|
| 5,092,783 | A * | 3/1992 | Suarez et al. | 439/71 |
| 5,513,996 | A | 5/1996 | Annerino et al. | |
| 5,575,691 | A | 11/1996 | Matthews | |
| 5,759,049 | A | 6/1998 | Gerber | |
| 6,198,444 | B1 * | 3/2001 | Sailsman et al. | 343/702 |
| 6,275,194 | B1 | 8/2001 | Ansorge | |
| 6,423,915 | B1 * | 7/2002 | Winter | 200/292 |
| 6,867,984 | B2 * | 3/2005 | Chen | 361/804 |
| 6,991,472 | B2 * | 1/2006 | Du et al. | 439/66 |
| 7,317,422 | B2 * | 1/2008 | Yun et al. | 343/702 |
| 7,598,924 | B2 * | 10/2009 | Hynes et al. | 343/906 |

FOREIGN PATENT DOCUMENTS

| | | | |
|---|---|---|---|
| KR | 1020030017915 | A | 3/2003 |
| KR | 20-0424639 | Y1 | 8/2006 |
| KR | 1020080018600 | A | 2/2008 |

OTHER PUBLICATIONS

International Search Report for PCT/KR2009/002436.

* cited by examiner

*Primary Examiner* — Hoang V Nguyen
(74) *Attorney, Agent, or Firm* — LRK Patent Law Firm

(57) ABSTRACT

An antenna connection device is provided, which includes: a flat plate-shaped fixing part; a first tension portion extending from an end of the fixing part and bent around; a free part including a long oblique portion extending from an end of the first tension portion and bent and extended so as to oppose the fixing part, and a short oblique portion bent and extended from an end of the long oblique portion; a second tension portion extending from the other end of the fixing part and bent around; and a supporting part including a flat portion flatly extending from an end of the second tension portion, and a curved surface portion bent and extended from an end of the flat portion so as to oppose the fixing part and bent around and extended toward the first tension portion, the curved surface portion being disposed under the free part.

16 Claims, 10 Drawing Sheets

ANTENNA CONNECTION DEVICE

CROSS REFERENCE TO RELATED APPLICATION

This application is a National Stage of International Application No. PCT/KR2009/002436 filed May 8, 2009, claiming priority based on Korean Patent Application No. 10-2008-0046205 filed May 19, 2008, the content of which is incorporated herein by reference in its entirety.

TECHNICAL FIELD

The present invention relates to an antenna connection device. More particularly, the present invention relates to an antenna connection device, which effectively dissipates an external load through two tension parts and a curved portion of a support part, thus obviating the necessity for a rubber stopper.

BACKGROUND ART

A conventional antenna connection device is provided with two fastening pieces, so that the fastening pieces are inserted into holes formed in a main PCB and then secured to the holes by soldering.

The invention dealing with the antenna connection device has been disclosed in Korean Patent Laid-Open Publication No. 2003-17915 which is entitled Antenna Connection Device For Mobile Phone. FIG. 1 is a perspective view showing an antenna connection device for a mobile phone according to this publication. As shown in FIG. 1, the antenna connection device 100 for the mobile phone includes a fixing part 110, a bent part 130, a free part 120, and an opening 140. The fixing part has on both side ends thereof fastening pieces 111 which are bent to face each other. The bent part 130 extends from an end of the fixing part, is bent at an end thereof toward the fixing part to provide an elastic force, and has a predetermined curvature radius. The free part includes an oblique portion 123 which is bent at an end of the bent part and extends in a direction away from the fixing part, and a connection portion 121 which is bent at a predetermined position of the oblique portion to make contact with an antenna bushing. The opening 140 is formed over the oblique portion and the bent part.

FIG. 2 is a side sectional view showing an antenna connection structure of a mobile phone using the antenna connection device for the mobile phone according to the laid-open publication. As shown in FIG. 2, the antenna connection device 100 of this publication is inserted into fastening holes of the main PCB 220 to be secured thereto.

In the conventional antenna connection device, two fastening pieces are required to connect the antenna connection device to the main PCB of the mobile phone. Further, it is necessary to form the fastening holes in the main PCB so that the fastening pieces can be inserted therein. As such, the conventional antenna connection device is problematic in that the process of manufacturing the main PCB and the antenna connection device for the mobile phone is expensive.

Further, the conventional antenna connection device is problematic in that the main PCB and the antenna connection device are joined together by soldering, so that it is unsuitable for an automatic mass production system.

FIG. 3 shows an antenna connection device according to the prior art of the present invention. The device is constructed so that, when an external deformation load is exerted on a connection portion 860, a short oblique portion 850 of a free part comes into contact with a rubber stopper 810, thus relieving shocks. The antenna connection device is problematic in that it is provided with the rubber stopper so as to maintain the function of a continuous contact point, so that production cost is increased and it takes longer to produce because of the mounting of the rubber stopper. Further, since it is very difficult to mount the rubber stopper, there may be a great number of defective goods.

FIG. 4 is a perspective view showing Korean U.M. Registration No. 20-0424639. When an external deformation load acts on the device shown in FIG. 4, a connection portion 934 slidably comes into contact with a second long oblique portion 951, so that a lot of cracks may form in the second long oblique portion. Further, a support part 950 is bent at an end thereof in the L shape, so that, when the end of the support part comes into contact with a fixing part 910 in response to the deformation load, the deformation load is not effectively dissipated. Thereby, a larger portion of the deformation load acts on a second tension part 940, and stress acing on the second tension part increases, so that the fatigability of a material increases. Further, when the deformation load is removed, the restoring force of the second tension part is reduced.

DISCLOSURE

Technical Problem

Accordingly, the present invention has been made keeping in mind the above problems occurring in the prior art, and an object of the present invention is to provide an antenna connection device, which removes the process of additionally mounting a rubber stopper, thus reducing the production cost, and removes the rubber-stopper mounting process that is highly difficult, thus preventing a great number of defective products from occurring as a result of the rubber-stopper mounting process. Further, another object of the present invention is to provide an antenna connection device, which has a double structure, thus effectively dissipating the fatigability of a material, therefore continuously and reliably maintaining the function of a contact point. A further object of the present invention is to provide an antenna connection device, which reduces the cracks that occur in a curvature portion of a support part when it makes contact with a free part in response to a deformation load, and in which the curvature portion of the support part effectively dissipates a deformation load when the curvature portion of the support part makes contact with a fixing part in response to the deformation load.

Technical Solution

In order to accomplish the above objects, according to the first aspect of the present invention, an antenna connection device includes a flat plate-shaped fixing part; a first tension part extending from a first end of the fixing part and curved in a circular shape; a free part including a long oblique portion which extends from an end of the first tension part and is bent in a direction opposite to the fixing part, and a short oblique portion which is bent and extends from an end of the long oblique portion; a second tension part extending from a second end of the fixing part and curved in a circular shape; and a support part including a flat portion which extends flat from an end of the second tension part, and a curved portion which extends from an end of the flat portion to be bent in a direction opposite to the fixing part and is curved in a circular shape to be extended toward the first tension part, wherein the curved portion is disposed under the free part.

The first tension part may have the same curvature radius as the second tension part.

A horizontal length of the first tension part and the free part may be shorter than a horizontal length of the second tension part and the support part.

An end of the curved portion may be located such that the end is closer to the fixing part than is the flat portion.

According to the second aspect of the present invention, an antenna connection device includes a flat plate-shaped fixing part; a first tension part extending from a first end of the fixing part and curved in a circular shape; a free part including a first flat portion which extends flat from an end of the first tension part, a second flat portion which extends flat from an end of the first flat portion and is bent in a direction opposite to the fixing part, and a first curved portion which extends from an end of the second flat portion and is curved in a circular shape toward a second tension part; the second tension part extending from a second end of the fixing part and curved in a circular shape; and a support part including an oblique portion which extends from an end of the second tension part and is bent in a direction opposite to the fixing part, and a second curved portion which extends from an end of the oblique portion in a direction opposite to the fixing part and is curved toward the second tension part, wherein the second curved portion is disposed under the first curved portion.

A curvature radius of the first tension part may be larger than that of the second tension part.

A horizontal length of the first tension part and the free part may be longer than a horizontal length of the second tension part and the support part.

The second flat portion may be perpendicular to the first flat portion.

A cut recess may be formed in a predetermined portion of the second tension part.

Meanwhile, according to the first or second aspect of the present invention, notches may be formed in both sides of the fixing part in such a way as to be opposite each other.

According to the third aspect of the present invention, an antenna connection device includes a flat plate-shaped fixing part; a first tension part extending from a first end of the fixing part and curved in a circular shape; a free part including a first flat portion which extends flat from an end of the first tension part, a second flat portion which extends flat from an end of the flat portion and is bent in a direction opposite to the fixing part, and a first curved portion which extends from an end of the second flat portion and is curved in a circular shape toward a curved support part; and the curved support part including two vertical portions which are bent at a second end of the fixing part to extend perpendicularly to the fixing part and are symmetrical with respect to each other, a holding portion which is bent at an end of one of the vertical portions in a circular shape with a predetermined curvature radius and is open toward the fixing part, and a curved horizontal portion which extends horizontally from an end of a remaining one of the vertical portions in a direction away from the fixing part, wherein the holding portion is disposed under the first curved portion.

According to the third aspect, a horizontal length of the first tension part and the free part may be longer than a horizontal length of the curved support part.

According to the third aspect, the second flat portion may be perpendicular to the first flat portion.

According to the third aspect, notches may be formed in both sides of the fixing part in such a way as to be opposite each other.

Advantageous Effects

An antenna connection device according to the first and second embodiments of the present invention is advantageous in that two tension parts are provided on both ends of a fixing part, so that a deformation load is distributed to two tension parts, thus reducing the deformation that the deformation load causes. Further, the two tension parts can provide a reliable and firm connection without mounting a rubber stopper, thus eliminating the additional rubber-stopper mounting process that exists in the prior art, therefore reducing the production cost, and preventing a great number of defective products from occurring in the rubber-stopper mounting process by eliminating the rubber-stopper mounting process that is highly difficult. Furthermore, the antenna connection device has a double structure, thus effectively dissipating the fatigability of a material, therefore continuously and reliably maintaining the function of a contact point.

According to the present invention, when a curved portion of a support part is in contact with a free part in response to a deformation load, the contact area is large but contact is made along a curved surface, thus reducing the cracks that form in the free part when contact is made.

DESCRIPTION OF REFERENCE CHARACTERS OF IMPORTANT PARTS

| | |
|---|---|
| 300: fixing part | 310: soldering notch |
| 320: holder | 400: first tension part |
| 500: second tension part | 510: cut recess |
| 600: free part | 610: long oblique portion |
| 620: short oblique portion | 630: connection portion |
| 640: support-part contact portion | |
| 650: vertical portion | 660: curved portion |
| 670: flat portion | 680: protrusion |
| 700: support part | 710: flat portion |
| 720: curved portion | 730: oblique portion |
| 800: curved support part | |
| 810: vertical portion | 820: holding portion |
| 830: horizontal portion | 1000: internal antenna |

MODE FOR INVENTION

Hereinafter, the construction and operation of an antenna connection device according to an embodiment of the present invention will be described in detail with reference to the accompanying drawings.

Figure 5:
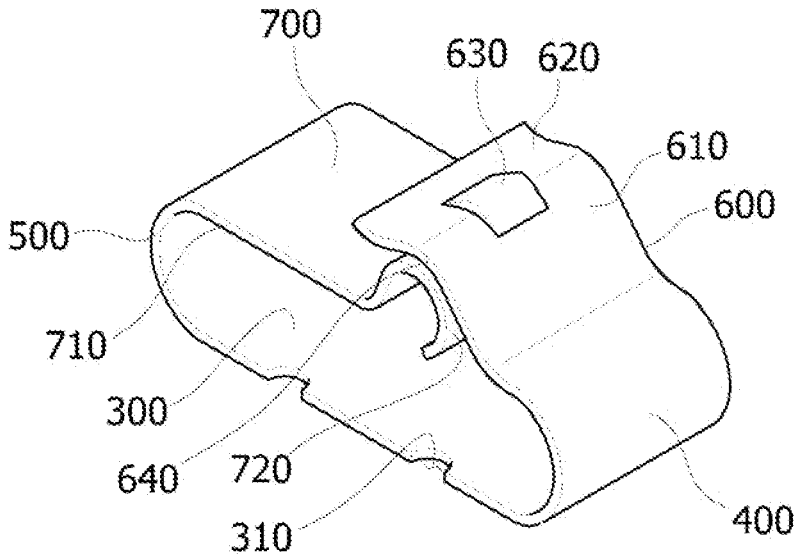
FIG. 5 is a perspective view showing an antenna connection device for a mobile phone, according to a first embodiment of the present invention.

FIG. 5 is a perspective view showing an antenna connection device for a mobile phone, according to the first embodiment of the present invention. As shown in FIG. 5, the antenna connection device for the mobile phone according to the first embodiment of the present invention includes a fixing part 300, a free part 600, a support part 700, a first tension part 400, and a second tension part 500. The fixing part 300 is adhered to a main PCB of the mobile phone by soldering. The free part 600 includes a connection portion 630, a long oblique portion 610, and a short oblique portion 620. The support part 700 includes a flat portion 710 and a curved portion 720. The first tension part 400 connects the fixing part with the free part. The second tension part 500 connects the fixing part with the support part. According to the first embodiment of the present invention, the antenna connection device has two tension parts, thus improving conductivity when electric waves are transmitted to the antenna.

The fixing part 300 has the shape of a flat plate, and is secured to the main PCB of the mobile phone by soldering, with soldering notches 310 being formed on both sides of the fixing part in such a way as to be opposite to each other. When soldering, each soldering notch 310 is filled with molten solder and then the solder is solidified. The solder fills the space between the main PCB and the lower surface of the fixing part. The antenna connection device has four soldering notches to reduce the possibility of defective contact, thus preventing cold soldering from occurring, in addition to improving the solderability. Further, the four soldering notches distribute the horizontal force which acts on the fixing part, and have considerable resistive force acting against the horizontal force which acts on the soldering notches in all directions, thus realizing firm soldering. Furthermore, the antenna connection device can be conveniently automatically mounted using a surface mount device (SMD), and the misalignment of the antenna connection device is prevented in the automatic mounting operation.

The first tension part 400 extends from one end of the fixing part 300, and is bent in a circular shape such that an end of the first tension part is parallel to the fixing part.

The free part 600 includes the long oblique portion 610 which extends from an end of the first tension part 400 in a direction away from the fixing part 300. The short oblique portion 620 is formed by bending a part of the long oblique portion 610 at a predetermined curvature, and extends toward the fixing part. The connection portion 630 is provided around a bent portion between the short oblique portion 620 and the long oblique portion, and is connected to an antenna. A support-part contact portion 640 is in contact with the curved portion 720 of the support part 700 when the deformation load is applied.

The connection portion 630 is connected to the internal or external antenna, while the support-part contact portion 640 is in contact with the curved portion 720 of the support part 700.

The second tension part 500 extends from the other end of the fixing part 300, and is bent in a circular shape such that an end of the second tension part is parallel to the fixing part.

The support part 700 includes the flat portion 710 which extends from an end of the second tension part 500 to a predetermined length in such a way as to be parallel to the fixing part. The curved portion 720 extends from an end of the flat portion 710, is bent toward the fixing part, and has a predetermined curvature. The curved portion 720 is disposed under the free part, and is constructed so that a part of the curved portion 720 comes into contact with the support-part contact portion 640 when an external deformation load is applied to the connection portion 630.

Further, a gap is formed between the support-part contact portion 640 and the curved portion 720 of the support part 700 so that they are in contact with each other when the first tension part is deformed after load has been applied to the connection portion 630. Or, the support-part contact portion is in contact with the curved portion.

Figure 6:
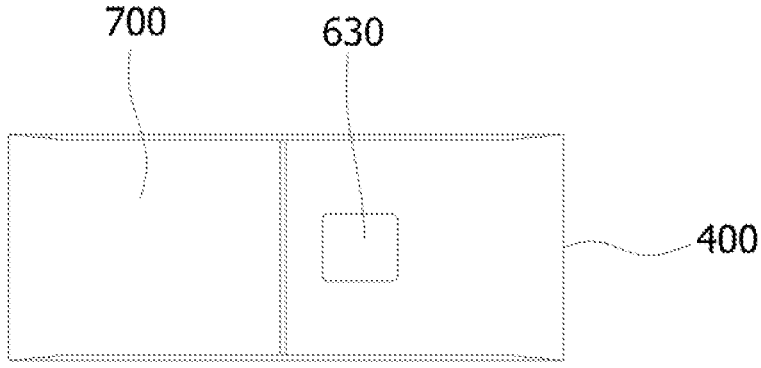
FIG. 6 is a plan view showing the antenna connection device for the mobile phone, according to the first embodiment of the present invention.

FIG. 6 is a plan view showing the antenna connection device for the mobile phone according to the first embodiment of the present invention.

Figure 7:
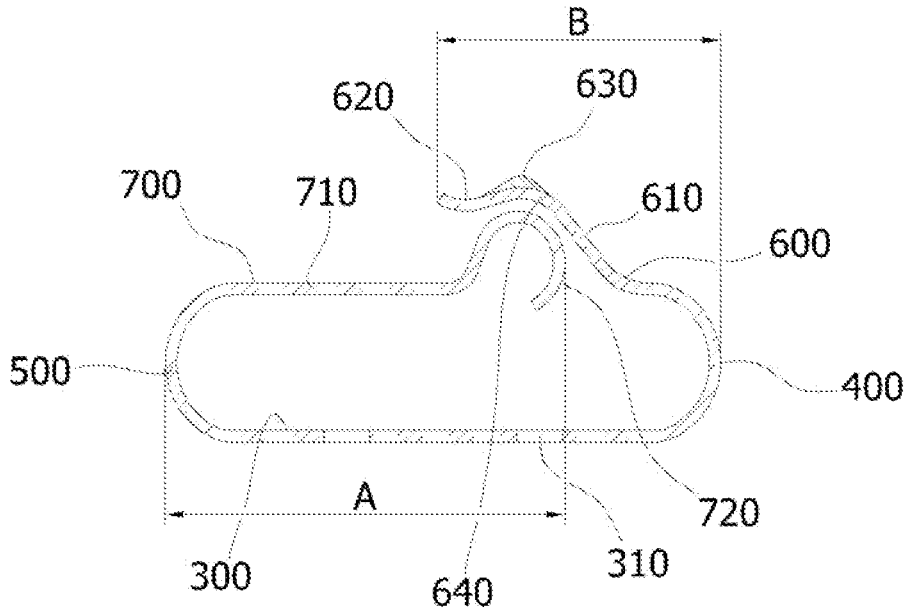
FIG. 7 is a side view showing the antenna connection device for the mobile phone, according to the first embodiment of the present invention.

FIG. 7 is a side view showing the antenna connection device for the mobile phone according to the first embodiment of the present invention. As shown in FIG. 7, an end of the curved portion 720 of the support part 700 is formed to be lower than the flat portion 710 of the support part 700. Thereby, when a deformation load is applied to the free part because of the contact of the connection portion 630 of the free part with the internal antenna, the curved portion 720 of the support part 700 is in contact with the upper surface of the fixing part prior to the flat portion 710 of the support part 700, so that the deformation load is dispersed onto the curved portion 720 of the support part. Therefore, when a deformation load acting on the second tension part 500 is reduced and consequently removed, the restoring force of the second tension part is improved. Further, more deformation load is required to reach the elastic limit of the second tension part, thus increasing the external shock that can be endured. Further, since the horizontal length A of the support part 700 is longer than the horizontal length B of the free part 600, the strain of the second tension part is small when the external deformation load is applied, so that a small amount of stress acts on the second tension part.

First, the external deformation load acts on the free part 600 of the antenna connection device for the mobile phone, and is dispersed onto the support part 700 because of the contact of the support-part contact portion 640 of the free part with the curved portion 720 of the support part 700. The dispersed deformation load acts on the first and second tension parts 400 and 500 of the connection device. Thereby, each tension part generates a deformation load which pushes the antenna connection device for the mobile phone toward the fixing part.

In the antenna connection device for the mobile phone according to the first embodiment of the present invention, the first and second tension parts 400 and 500 are provided on both ends of the fixing part, so that the deformation load is distributed to the two tension parts, thus reducing the extent of deformation of the first tension part 400 by the deformation load. Further, the deformation load generated in the direction of the fixing part in the first tension part is offset from the deformation load generated in the direction of the fixing part in the second tension part, thus contributing to firm soldering. Further, the two tension parts achieve reliable and firm connection without mounting a rubber stopper, thus eliminating an additional rubber-stopper mounting process that exists in the prior art, therefore reducing product cost. Owing to the elimination of the rubber-stopper mounting process that is highly difficult, the production of a great number of defective products is prevented. Further, such a double structure effectively dissipates the fatigability of a material, so that the function of the contact point can be continuously and reliably maintained.

According to the first embodiment of the present invention, when the curved portion 720 of the support part 700 is put into contact with the free part 600 by the deformation load, the contact area is increased, but the contact of the curved portion 720 of the support part 700 is made along a curve, so that the cracks of the curved portion 720 of the support part 700 caused by the contact are reduced.

Figure 8:
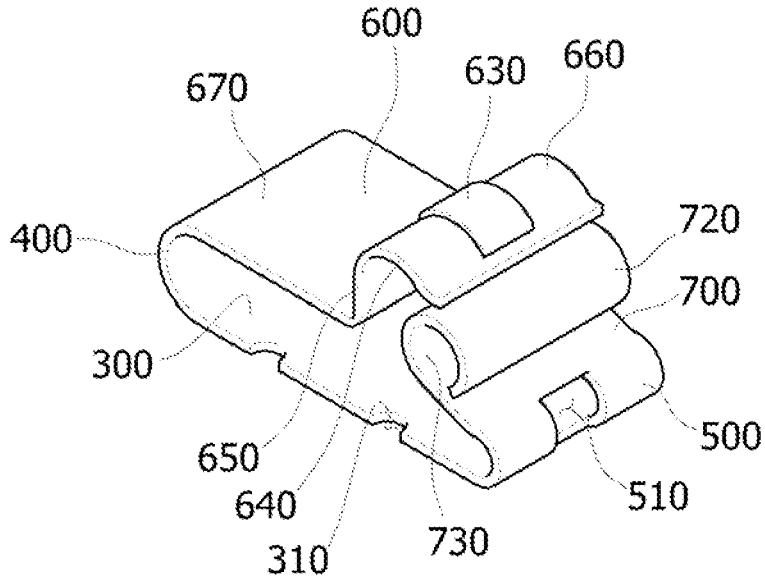
FIG. 8 is a perspective view showing an antenna connection device for a mobile phone, according to a second embodiment of the present invention.

FIG. 8 is a perspective view showing an antenna connection device for a mobile phone, according to the second embodiment of the present invention. As shown in FIG. 8, the antenna connection device for the mobile phone according to the second embodiment of the present invention includes a fixing part 300, a free part 600, a support part 700, a first tension part 400, and a second tension part 500. The fixing part 300 is adhered to a main PCB of the mobile phone by soldering. The free part 600 includes a connection portion 630, a flat portion 670, and a vertical portion 650. The support part 700 includes an oblique portion 730 and a curved portion 720. The first tension part 400 connects the fixing part with the free part. The second tension part 500 connects the fixing part with the support part. According to the second embodiment of the present invention, the antenna connection device has two tension parts, thus improving conductivity when electric waves are transmitted to the antenna.

The fixing part 300 has the shape of a flat plate, and is secured to the main PCB of the mobile phone by soldering, with soldering notches 310 being formed on both sides of the fixing part in such a way as to be opposite to each other. When soldering, each soldering notch 310 is filled with molten solder and then the solder is solidified. The solder fills the space between the main PCB and the lower surface of the fixing part. The antenna connection device has four soldering notches to reduce the possibility of defective contact, thus preventing cold soldering from occurring, in addition to improving the solderability. Further, the four soldering notches distribute the horizontal force which acts on the fixing part, and have considerable resistive force acting against the horizontal force which acts on the soldering notches in all directions, thus realizing firm soldering. Furthermore, the antenna connection device can be conveniently automatically mounted using a surface mount device (SMD), and the misalignment of the antenna connection device is prevented in the automatic mounting operation.

The first tension part 400 extends from one end of the fixing part 300, and is bent in a circular shape such that an end of the first tension part is parallel to the fixing part.

The free part 600 includes the flat portion 670 which extends from an end of the first tension part 400 to be parallel to the fixing part 300. The vertical portion 650 is bent perpendicularly to an end of the flat portion 670 and extends in a direction perpendicular to the fixing part. The curved portion 660 is bent from an end of the vertical portion 650 in a circular shape to have a predetermined curvature radius and is open toward the fixing part. The connection portion 630 is provided on the upper surfaces of the vertical portion 650 and the curved portion 660 and is connected to an antenna. A support-part contact portion 640 comes into contact with the curved portion 720 of the support part 700 in response to a deformation load.

The connection portion 630 is connected to the internal or external antenna, while the support-part contact portion 640 is in contact with the curved portion 720 of the support part 700.

The second tension part 500 extends from the other end of the fixing part 300, and is bent in a circular shape such that an end of the second tension part is parallel to the fixing part. A rectangular cut recess 510 is formed in a predetermined portion of the circularly bent surface of the second tension part.

The support part 700 includes the oblique portion 730 which extends from an end of the second tension part 500 to a predetermined length in a direction away from the fixing part. The curved portion 720 extends upwards from an end of the oblique portion 730 and then extends to the second tension part to have a predetermined curvature radius, and is open at an end thereof. The support part 700 is disposed under the free part and is constructed so that a part of the curved portion 720 comes into contact with the support-part contact portion 640 when an external deformation load is applied to the connection portion 630.

Further, a gap is formed between the support-part contact portion 640 and the curved portion 720 of the support part so that they are in contact with each other when the first tension part is deformed after load has been applied to the connection portion 630. Or, the support-part contact portion is in contact with the curved portion.

Figure 9:
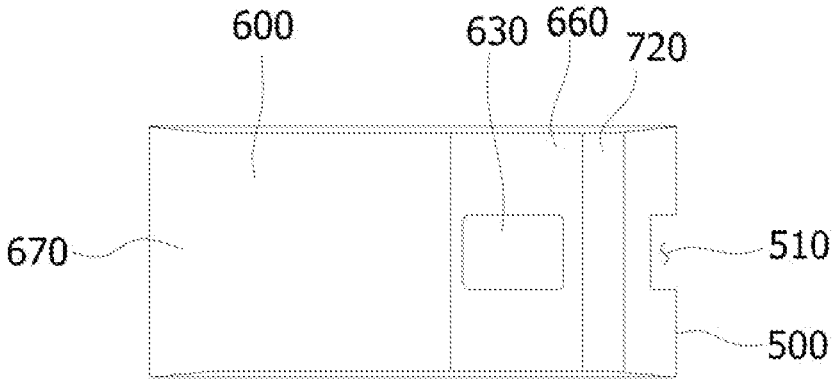
FIG. 9 is a plan view showing the antenna connection device for the mobile phone, according to the second embodiment of the present invention.

FIG. 9 is a plan view showing the antenna connection device for the mobile phone according to the second embodiment of the present invention.

Figure 10:
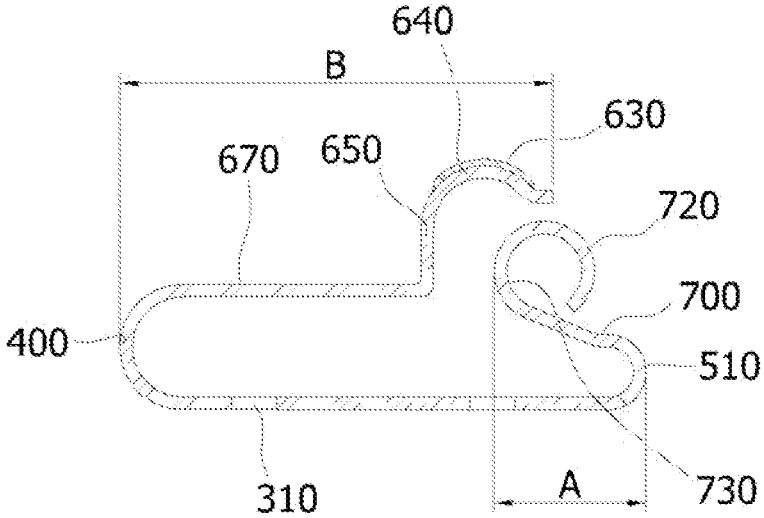
FIG. 10 is a side view showing the antenna connection device for the mobile phone, according to the second embodiment of the present invention.

FIG. 10 is a side view showing the antenna connection device for the mobile phone according to the second embodiment of the present invention. As shown in FIG. 10, the curved portion 720 of the support part 700 has a predetermined curvature radius. Thus, when the deformation load is applied to the free part by the connection of the connection portion 630 of the free part with the internal antenna, the deformation load is dispersed onto the curved portion 720 of the support part, so that a load acting on the second tension part 500 is reduced. Therefore, when the deformation load is removed, the restoring force of the second tension part is improved. Further, more deformation load is required to reach the elastic limit of the second tension part, thus increasing the external shock that can be endured. Further, as shown in FIG. 10, since the horizontal length A of the support part 700 is shorter than the horizontal length B of the free part 600, the strain of the first tension part is small when the external deformation load is applied, so that a small amount of stress acts on the first tension part. Meanwhile, it is preferable that the curvature radius of the first tension part be larger than that of the second tension part.

In the second embodiment of the present invention, first, the external deformation load acts on the free part 600 of the antenna connection device for the mobile phone. Next, the external deformation load is dispersed onto the support part 700 because of the contact of the support-part contact portion 640 of the free part with the curved portion 720 of the support part 700. The dispersed deformation load acts on the first and second tension parts 400 and 500 of the connection device. Thereby, each tension part generates a deformation load which pushes the antenna connection device for the mobile phone toward the fixing part.

In the antenna connection device for the mobile phone according to the first embodiment of the present invention, the first and second tension parts 400 and 500 are provided on both ends of the fixing part, so that the deformation load is distributed to the two tension parts, thus reducing the extent of deformation of the first tension part 400 by the deformation load. Further, the deformation load generated in the direction of the fixing part in the first tension part is offset from the deformation load generated in the direction of the fixing part in the second tension part, thus contributing to firm soldering. Further, the two tension parts achieve reliable and firm connection without mounting a rubber stopper, thus eliminating an additional rubber-stopper mounting process that exists in the prior art, therefore reducing product cost. Owing to the elimination of the rubber-stopper mounting process that is highly difficult, the production of a great number of defective products is prevented. Further, such a double structure effectively dissipates the fatigability of a material, so that the function of the contact point can be continuously and reliably maintained.

According to the second embodiment of the present invention, when the curved portion 720 of the support part 700 is put into contact with the free part 600 by the deformation load, the contact area is increased. However, the curved portion 720 of the support part is in contact with the curved portion 660 of the free part with a predetermined curvature radius. Thus, the cracks of the curved portion 720 of the support part 700 caused by the contact are reduced.

Figure 11:
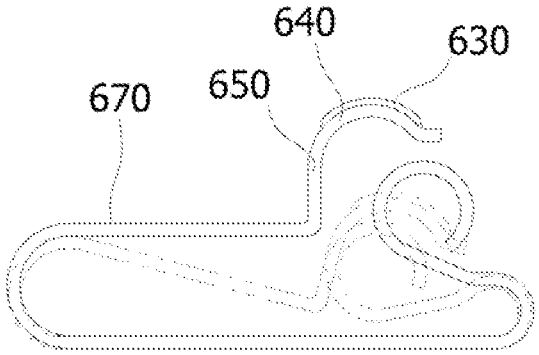
FIG. 11 is a view showing the antenna connection device before and after it is deformed when a deformation load acts on the antenna connection device according to the second embodiment of the present invention.

FIG. 11 is a view showing the antenna connection device before and after it becomes deformed when a deformation load acts on the antenna connection device according to the second embodiment of the present invention. When an external deformation load is applied, the deformation load acts on the free part and the free part comes into contact with the support part, so that the deformation load is distributed again over the support part and the two tension parts.

Figure 12:
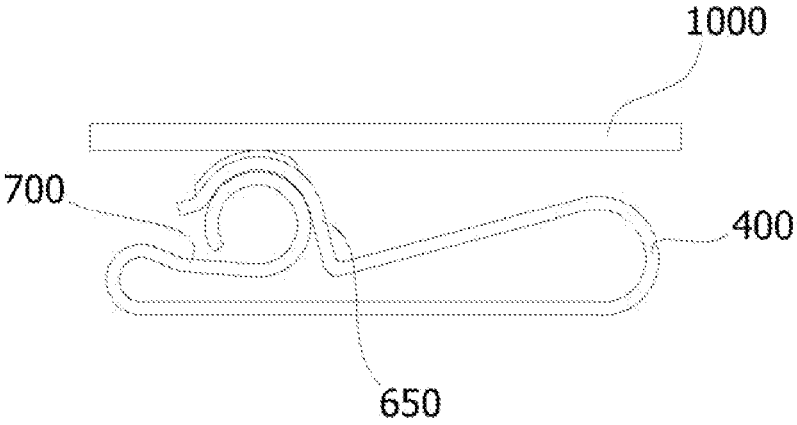
FIG. 12 is a view showing the antenna connection device according to the second embodiment of the present invention, when it is installed in an internal antenna 1000.

FIG. 12 is a view showing the antenna connection device for the mobile phone according to the second embodiment of the present invention, when it is installed in an internal antenna 1000. Here, the internal antenna 1000 is connected to the connection portion 630 of the free part.

Figure 13:
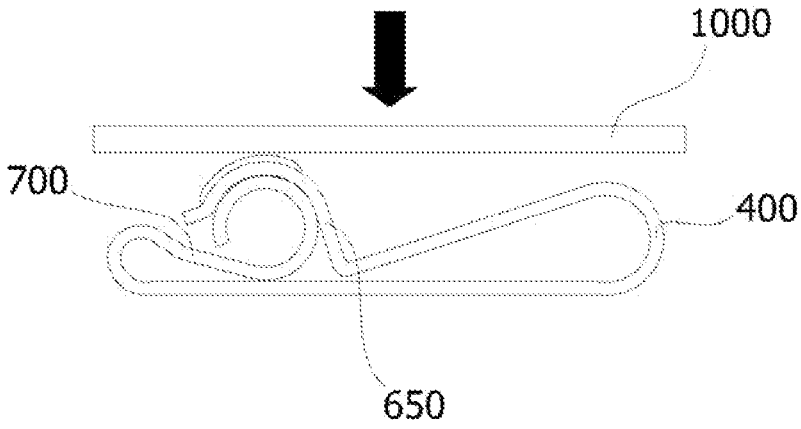
FIG. 13 is a view showing the antenna connection device according to the second embodiment of the present invention, when a deformation load acts on the internal antenna 1000 so that the antenna connection device becomes deformed.

FIG. 13 is a view showing the antenna connection device for the mobile phone according to the second embodiment of the present invention, when a deformation load acts on the internal antenna 1000 so that the antenna connection device becomes deformed. As shown in the drawing, if the curved portion 720 of the support part 700 comes into contact with the upper surface of the fixing part 300, an external deformation load is distributed and then exerted on the curved portion 720 of the support part 700. Thus, even when a larger deformation load is exerted, the deformation load does not affect the first tension part 400 so that the stress thereon is not increased. Further, the two tension parts serve as a conventional rubber stopper, so that the rubber stopper is not required.

Figure 14:
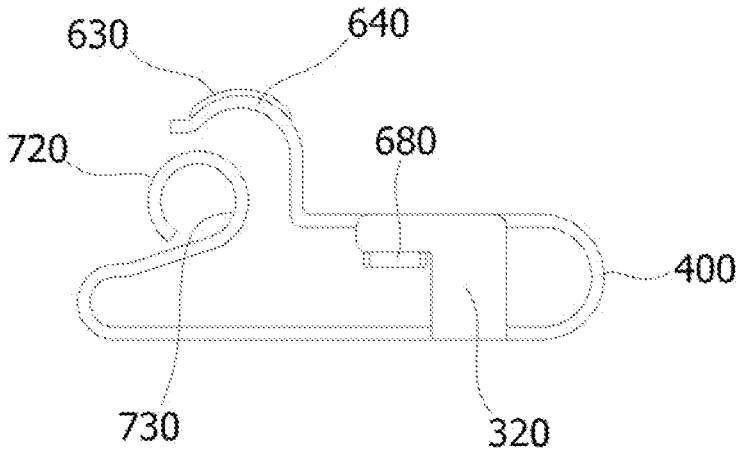
FIG. 14 is a side view showing an antenna connection device for a mobile phone according to a third embodiment of the present invention, in which the antenna connection device further includes holders 320 on both sides of a fixing part 300 and protrusions 680 on both sides of a free part, unlike the second embodiment.

FIG. 14 is a side view showing an antenna connection device for a mobile phone according to a third embodiment of the present invention, in which the antenna connection device further includes holders 320 on both sides of a fixing part 300 and protrusions 680 on both sides of a free part, unlike the second embodiment. Since the antenna connection device of the third embodiment is equivalent to that of the second embodiment except for the holders and the protrusions, the holders and the protrusions will be mainly described below. The protrusions 680 of the free part are held by the holders 320 which are provided on both sides of the fixing part, so that the flat portion 670 of the free part 600 is kept horizontal and thus a predetermined stress acts as if a predetermined deformation load was exerted on the first tension part 400. Such a construction provides the effect of applying a predetermined external deformation load even if no external deformation load acts on the first tension part 400. Thus, when a deformation load is applied from the outside, the distance that the free part moves is shortened. Further, when the external deformation load increases, it increases almost linearly. Therefore, when a small deformation load is exerted, the distance that the free part 600 moves is prevented from being increased. Further, the flat portion 670 of the free part 600 stays horizontal, so that more convenient work is possible when air is sucked to lift up the antenna connection device so that a soldering operation can be performed.

Figure 15:
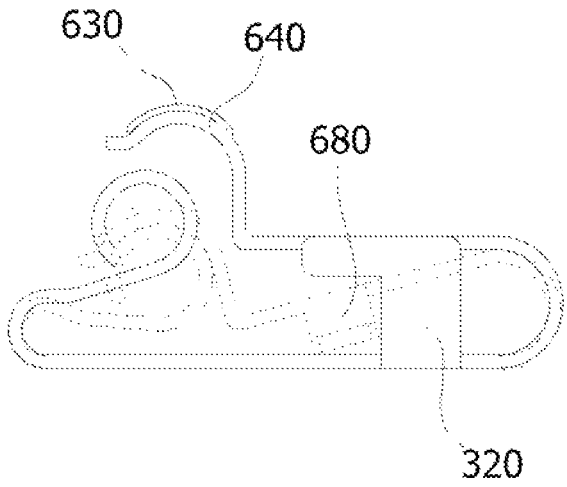
FIG. 15 is a view showing the free part which is deformed when a deformation load acts on the antenna connection device according to the third embodiment of the present invention.

FIG. 15 is a view showing the free part which is deformed when a deformation load acts on the antenna connection device according to the third embodiment of the present invention.

Figure 16:
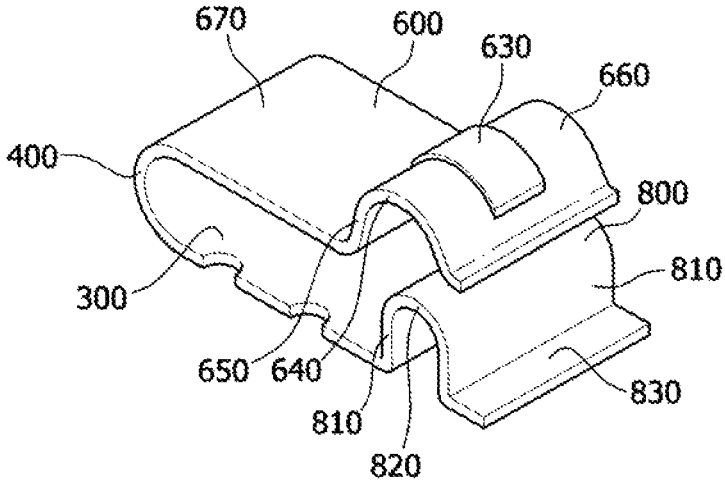
FIG. 16 is a perspective view showing an antenna connection device for a mobile phone according to a fourth embodiment of the present invention.
Figure 17:
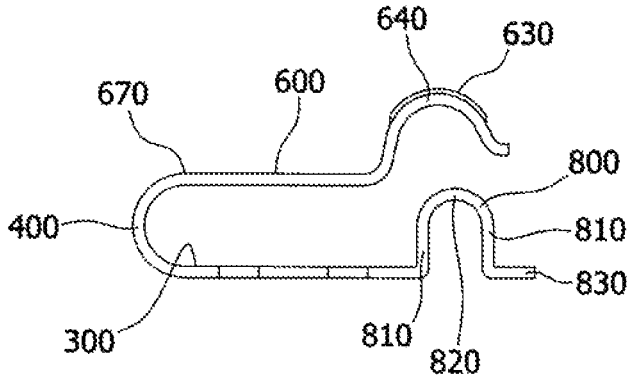
FIG. 17 is a side view showing the antenna connection device for the mobile phone according to the fourth embodiment of the present invention.
Figure 18:
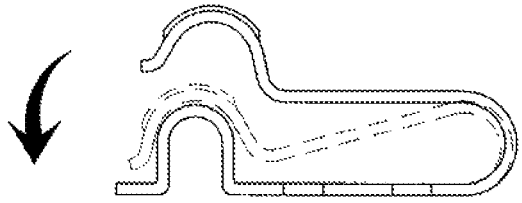
FIG. 18 is a view showing the antenna connection device before and after it is deformed when a deformation load acts on the antenna connection device according to the fourth embodiment of the present invention.

FIG. 16 is a perspective view showing an antenna connection device for a mobile phone according to the fourth embodiment of the present invention. FIG. 17 is a side view showing the antenna connection device for the mobile phone according to the fourth embodiment of the present invention. FIG. 18 is a view showing the antenna connection device before and after it is deformed when a deformation load acts on the antenna connection device according to the fourth embodiment of the present invention.

As shown in FIG. 16, the antenna connection device for the mobile phone according to the fourth embodiment of the present invention includes a fixing part 300, a free part 600, a curved support part 800, and a first tension part 400. The fixing part 300 is adhered to a main PCB of the mobile phone by soldering. The free part 600 includes a connection portion 630, a flat portion 670, and a vertical portion 650. The curved support part 800 includes vertical portions 810, a holding portion 820, and a horizontal portion 830. The first tension part 400 connects the fixing part with the free part.

The fixing part 300 has the shape of a flat plate, and is secured to the main PCB of the mobile phone by soldering, with soldering notches 310 being formed on both sides of the fixing part in such a way as to be opposite to each other. When soldering, each soldering notch 310 is filled with molten solder and then the solder is solidified. The solder fills the space between the main PCB and the lower surface of the fixing part. The antenna connection device has four soldering notches to reduce the possibility of defective contact, thus preventing cold soldering from occurring, in addition to improving the solderability. Further, the four soldering notches distribute the horizontal force which acts on the fixing part, and have considerable resistive force acting against the horizontal force which acts on the soldering notches in all directions, thus realizing firm soldering. Furthermore, the antenna connection device can be conveniently automatically mounted using a surface mount device (SMD), and the misalignment of the antenna connection device is prevented in the automatic mounting operation.

The first tension part 400 extends from one end of the fixing part 300, and is bent in a circular shape such that an end of the first tension part is parallel to the fixing part.

The free part 600 includes the flat portion 670 which extends from an end of the first tension part 400 to be parallel to the fixing part 300. The vertical portion 650 is bent perpendicularly to an end of the flat portion 670 and extends in a direction perpendicular to the fixing part. The curved portion 660 is bent from an end of the vertical portion 650 in a circular shape to have a predetermined curvature radius and is open toward the fixing part. The connection portion 630 is provided on the upper surfaces of the vertical portion 650 and the curved portion 660 and is connected to an antenna. A support-part contact portion 640 comes into contact with the holding portion 820 of the curved support part 800 in response to a deformation load.

The connection portion 630 is connected to the internal or external antenna, while the support-part contact portion 640 is in contact with the holding portion 820 of the curved support part 800.

The curved support part 800 includes a first vertical portion 810 which is bent perpendicularly to an end of the fixing part 300 in such a way as to extend perpendicularly to the fixing part. The holding portion 820 is bent at an end of the vertical portion 810 into a circular shape with a predetermined curvature radius, and is open toward the fixing part. A second vertical portion 810 is bent downwards from an end of the holding portion 820 in such a way as to extend perpendicularly to the fixing part. The horizontal portion 830 is bent horizontally at an end of the vertical portion 810 and extends horizontally in a direction away from the fixing part. The curved support part 800 is constructed so that it is disposed under the free part and a part of the holding portion 820 comes into contact with the support-part contact portion 640 when an external deformation load is applied to the connection portion 630.

Further, a gap is formed between the support-part contact portion 640 and the holding portion 820 so that they are in contact with each other when the first tension part is deformed after load has been applied to the connection portion 630. Or, the support-part contact portion is in contact with the holding portion.

Figure 1:
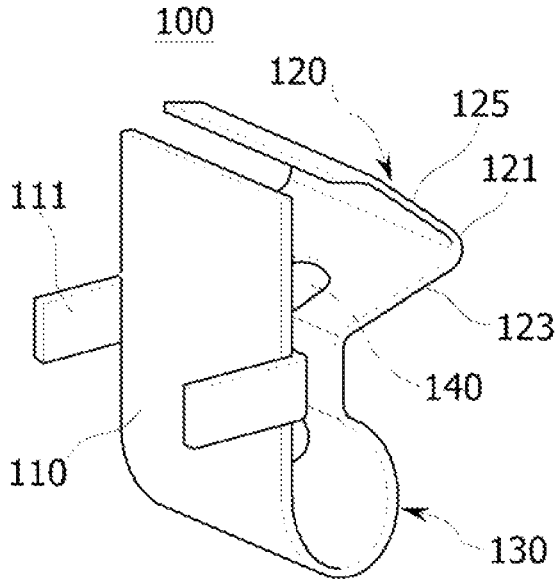
FIG. 1 is a perspective view showing a conventional antenna connection device for a mobile phone.
Figure 2:
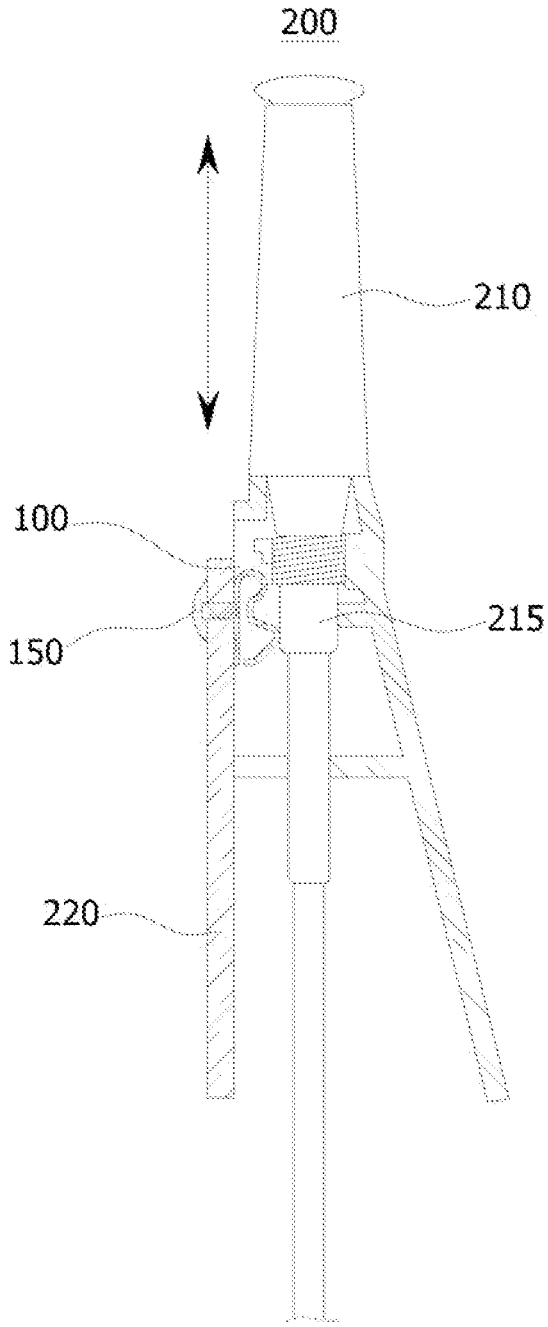
FIG. 2 is a side sectional view showing an antenna connection structure of a mobile phone using the conventional antenna connection device for the mobile phone.
Figure 3:
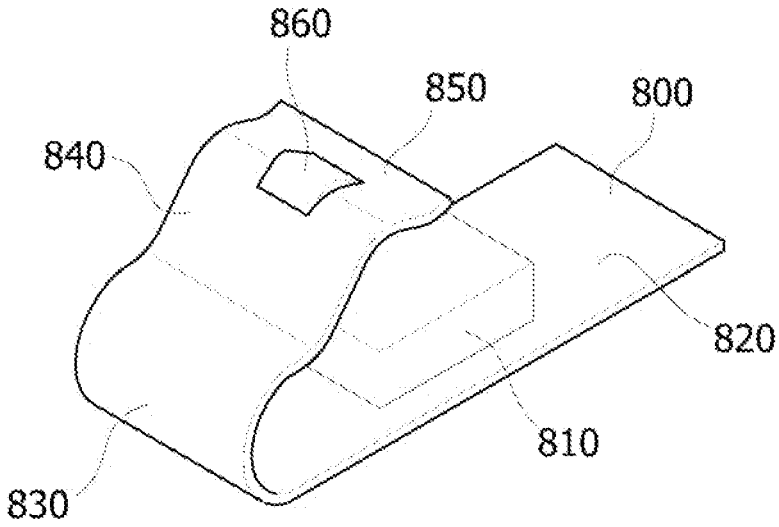
FIG. 3 is a view showing another conventional antenna connection device for a mobile phone.
Figure 4:
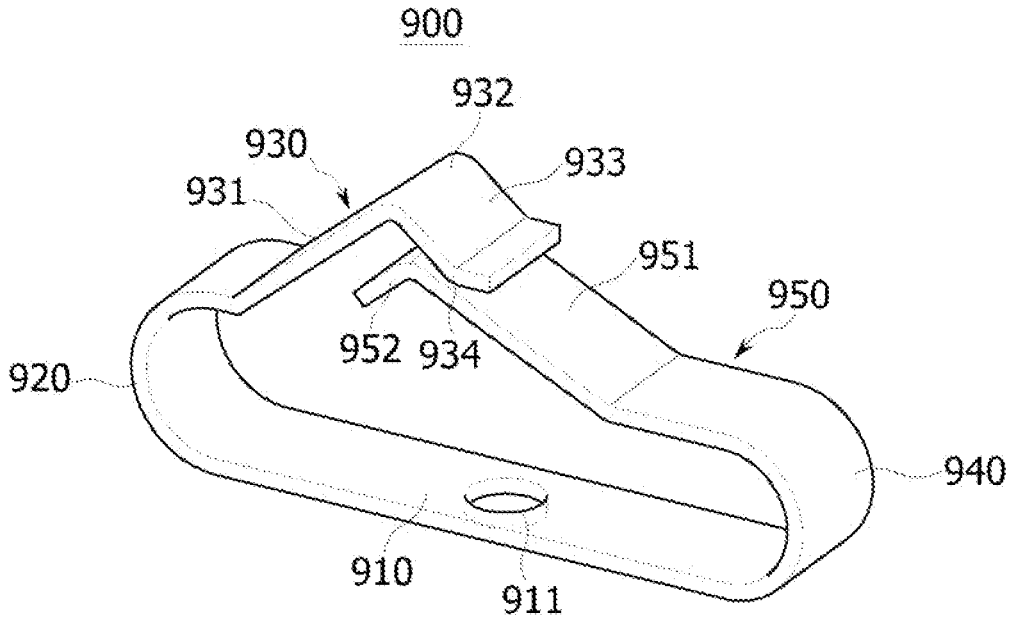
FIG. 4 is a perspective view showing a further conventional antenna connection device according to the Korean U.M. Registration No. 20-0424639.

Hereinafter, the durability of the conventional antenna connection device for the mobile phone that is shown in FIG. 3 will be compared with that of the antenna connection device for the mobile phone according to the fourth embodiment. As for the conventional antenna connection device, it is normal until a PUSH ratio reaches 50%. However, if the PUSH ratio is above 60%, the connection portion becomes deformed. If the PUSH ratio is above 70%, the connection portion is broken. In contrast, as for the antenna connection device for the mobile phone according to the fourth embodiment, it is normal until the PUSH ratio reaches 60%. If the PUSH ratio is above 70%, the connection portion is deformed but is not broken. Further, when a load is applied to the antenna connection device and then the antenna connection device is restored to its original position, there is only a small change in displacement. As for the force resistant to the load, the conventional antenna connection device endures up to 5.0 Kg, whereas the antenna connection device of the fourth embodiment endures 20 Kg.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

INDUSTRIAL APPLICABILITY

As described above, the present invention provides an antenna connection device, which effectively dissipates an external load through two tension parts and a curved portion of a support part, thus obviating the necessity for a rubber stopper.

The present invention provides an antenna connection device, which includes a flat plate-shaped fixing part; a first tension part extending from a first end of the fixing part and curved in a circular shape; a free part including a long oblique portion which extends from an end of the first tension part and is bent in a direction opposite to the fixing part, and a short oblique portion which is bent and extends from an end of the long oblique portion; a second tension part extending from a second end of the fixing part and curved in a circular shape; and a support part including a flat portion which extends flat from an end of the second tension part, and a curved portion which extends from an end of the flat portion to be bent in a direction opposite to the fixing part and is curved in a circular shape to be extended toward the first tension part, wherein the curved portion is disposed under the free part.

Since the purpose of the patent system is to encourage, protect and utilize inventions, thereby improving and developing technology, and to contribute to the development of industry, the invention is required to have industrial applicability. The above-mentioned antenna connection device is a product invention, so that mass production is possible and thus the industrial applicability is approved.

The invention claimed is:

1. An antenna connection device comprising:

a flat plate-shaped fixing part;

a first tension part extending from a first end of the fixing part and curved in a circular shape;

a free part including a long oblique portion which extends from an end of the first tension part and is bent in a direction opposite to the fixing part, and a short oblique portion which is bent and extends from an end of the long oblique portion;

a second tension part extending from a second end of the fixing part and curved in a circular shape; and a support part including a flat portion which extends flat from an end of the second tension part, and a curved portion which extends from an end of the flat portion to be bent in a direction opposite to the fixing part and is curved in a circular shape to be extended toward the first tension part, wherein the curved portion is disposed under the free part, and wherein an end of the curved portion is located such that the end is closer to the fixing part than is the flat portion.

2. An antenna connection device comprising:

a flat plate-shaped fixing part;

a first tension part extending from a first end of the fixing part and curved in a circular shape;

end of the fixing part to extend perpendicularly to the fixing part and are symmetrical with respect to each other, a holding portion which is bent at an end of one of the vertical portions in a circular shape with a predetermined curvature radius and is open toward the fixing part, and a curved horizontal portion which extends horizontally from an end of a remaining one of the vertical portions in a direction away from the fixing part, wherein the holding portion is disposed under the first curved portion.

3. An antenna connection device comprising:

a flat plate-shaped fixing part;

a first tension part extending from a first end of the fixing pan and curved in a circular shape;

a free part including a first flat portion which extends flat from an end of the first tension part, a second flat portion which extends flat from an end of the first flat portion and is bent in a direction opposite to the fixing part, and a first curved portion which extends from an end of the second flat portion and is curved in a circular shape toward a second tension part;

the second tension part extending from a second end of the fixing part and curved in a circular shape; and a support part including an oblique portion which extends from an end of the second tension part and is bent in a direction opposite to the fixing part, and a second curved portion which extends from an end of the oblique portion in a direction opposite to the fixing part and is curved toward the second tension part, wherein the second curved portion is disposed under the first curved portion.

4. The antenna connection device according to claim 3, wherein a curvature radius of the first tension part is larger than that of the second tension part.

5. The antenna connection device according to claim 3, wherein a horizontal length of the first tension part and the free part is longer than a horizontal length of the second tension part and the support part.

6. The antenna connection device according to claim 3, wherein the second flat portion is perpendicular to the first flat portion.

7. The antenna connection device according to claim 3, wherein a cut recess is formed in a predetermined portion of the second tension part.

8. The antenna connection device according to claim 3, wherein the free part further comprises a protrusion which is provided at a predetermined position of the free part and is held by a holder to keep a surface of the flat portion horizontal, and the fixing part further comprises a holder which is provided at a position corresponding to the holder of the free part so that the protrusion of the free part is held by the holder, whereby the protrusion of the free part is held by the holder of the fixing part, so that the flat portion is maintained horizontal and thus provides an effect that applies a predetermined deformation load to the first tension part.

9. The antenna connection device according to claim 8, wherein a free part including a long oblique portion which extends from an end of the first tension part and is bent in a direction opposite to the fixing part, and a short oblique portion which is bent and extends from an end of the long oblique portion;

a second tension part extending from a second end of the fixing part and curved in a circular shape; and a support part including a flat portion which extends flat from an end of the second tension part, and a curved portion which extends from an end of the flat portion to be bent in a direction opposite to the fixing part and is curved in a circular shape to be extended toward the first tension part, wherein the curved portion is disposed under the free part, and wherein notches are formed in both sides of the fixing, part in such a way as to be opposite each other.

10. The antenna connection device according to claim 3, wherein notches are formed in both sides of the fixing part in such a way as to be opposite each other.

11. An antenna connection device comprising:

a flat plate-shaped fixing part;

a first tension part extending from a first end of the fixing part and curved in a circular shape;

a free part including a first flat portion which extends flat from an end of the first tension pan, a second flat portion which extends flat from an end of the flat portion and is bent in a direction opposite to the fixing part, and a first curved portion which extends from an end of the second flat portion and is curved in a circular shape toward a curved support part; and the curved support part including two vertical portions which are bent at a second notches are formed in both sides of the fixing part in such a way as to be opposite each other.

12. The antenna connection device according to claim 11, wherein a horizontal length of the first tension part and the free part is longer than a horizontal length of the curved support part.

13. The antenna connection device according to claim 12, wherein notches are formed in both sides of the fixing part in such a way as to be opposite each other.

14. The antenna connection device according to claim 11, wherein the second flat portion is perpendicular to the first flat portion.

15. The antenna connection device according to claim 14, wherein notches are formed in both sides of the fixing part in such a way as to be opposite each other.

16. The antenna connection device according to claim 11, wherein notches are formed in both sides of the fixing part in such a way as to be opposite each other.

* * * * *